US009854948B1

(12) United States Patent
Paal et al.

(10) Patent No.: US 9,854,948 B1
(45) Date of Patent: Jan. 2, 2018

(54) PAPER TOWEL DISPENSER

(71) Applicant: Wisconsin Plastics, Inc., Green Bay, WI (US)

(72) Inventors: Alan P Paal, New Franken, WI (US); Mathew T Wilcox, Green Bay, WI (US)

(73) Assignee: Wisconsin Plastics, Inc., Green Bay, WI (US)

( * ) Notice: Subject to any disclaimer, the term of this patent is extended or adjusted under 35 U.S.C. 154(b) by 2 days.

(21) Appl. No.: 14/675,055

(22) Filed: Mar. 31, 2015

(51) Int. Cl.
*B23D 25/02* (2006.01)
*B26D 7/00* (2006.01)
*A47K 10/36* (2006.01)
*A47K 10/32* (2006.01)

(52) U.S. Cl.
CPC .. *A47K 10/3631* (2013.01); *A47K 2010/3233* (2013.01)

(58) Field of Classification Search
CPC ..... A47K 10/3631; A47K 2010/3233; A47K 2010/3246
USPC ..... 83/649, 322, 337, 345, 650, 42
See application file for complete search history.

(56) References Cited

U.S. PATENT DOCUMENTS 3,182,540 A 5/1965 Eichorn et al.
3,288,387 A 11/1966 Craven, Jr.
3,459,353 A * 8/1969 Taylor ..... A47K 10/36 226/132
3,896,691 A * 7/1975 Granger ..... B65H 35/0066 225/17
4,107,696 A * 8/1978 Wondra ..... G01D 15/28 346/24
4,404,880 A * 9/1983 DeLuca ..... A47K 10/3687 242/527.1
4,406,421 A 9/1983 Schultz et al.
4,432,261 A 2/1984 DeLuca
4,441,392 A 4/1984 DeLuca
4,487,375 A * 12/1984 Rasmussen ..... A47K 10/3687 226/174
4,552,315 A * 11/1985 Granger ..... A47K 10/3643 242/560.3
4,712,461 A * 12/1987 Rasmussen ..... A47K 10/3643 225/106
4,846,035 A * 7/1989 Granger ..... A47K 10/3643 83/337
5,048,386 A * 9/1991 DeLuca ..... A47K 10/3643 225/106
5,244,161 A * 9/1993 Wirtz-Odenthal . A47K 10/3687 242/560.1
5,375,785 A 12/1994 Boone et al.
5,441,189 A 8/1995 Formon et al.
5,857,393 A 1/1999 Kohiyama
5,924,617 A 7/1999 LaCount et al.
(Continued)

FOREIGN PATENT DOCUMENTS

EP 1232715 B1 11/2005

*Primary Examiner* — Ghassem Alie
*Assistant Examiner* — Bharat C Patel
(74) *Attorney, Agent, or Firm* — Andrus Intellectual Property Law, LLP

(57) ABSTRACT

A paper toweling dispenser for dispensing paper toweling from a roll of paper toweling including a top roller located between the paper roll and the drum of the dispenser which moves in radial cams along the outer circumference of the drum as a pulling force is applied to the leading edge of the paper toweling by a user.

8 Claims, 18 Drawing Sheets

(56) References Cited

U.S. PATENT DOCUMENTS 6,079,305 A * 6/2000 Bloch ..... B65H 19/10 83/335
6,321,963 B1 * 11/2001 Gracyalny ..... A47K 10/3656 225/16
6,363,824 B1 * 4/2002 Granger ..... A47K 10/3643 242/560
6,415,948 B1 * 7/2002 Granger ..... A47K 10/3637 221/30
6,450,076 B1 * 9/2002 Granger ..... A47K 10/3643 242/527.1
6,460,798 B1 * 10/2002 Haen ..... A47K 10/3687 242/560
6,474,209 B1 * 11/2002 Granger ..... A47K 10/3643 221/30
6,553,879 B2 4/2003 Morand
6,607,160 B2 8/2003 Lewis et al.
6,684,751 B2 * 2/2004 Kapiloff ..... A47K 10/3656 225/16
6,710,606 B2 * 3/2004 Morris ..... A47K 10/36 324/207.12
6,736,348 B1 5/2004 Formon et al.
6,826,991 B1 * 12/2004 Rasmussen ..... A47K 10/3687 226/91
6,903,654 B2 * 6/2005 Hansen ..... A47K 10/36 242/563
7,040,566 B1 * 5/2006 Rodrian ..... A47K 10/36 242/563
7,234,381 B2 * 6/2007 Granger ..... A47K 10/3643 225/16
7,237,744 B2 7/2007 Morris et al.
7,270,292 B2 9/2007 Rasmussen
7,354,015 B2 4/2008 Byrd et al.
7,500,420 B2 3/2009 Cvjetkovic et al.
7,571,670 B2 * 8/2009 Formon ..... A47K 10/3643 225/96
7,913,598 B2 * 3/2011 Granger ..... A47K 10/3637 242/564
7,987,756 B2 * 8/2011 Lewis ..... A47K 10/3625 225/106
8,082,827 B2 * 12/2011 Friesen ..... B26D 1/42 83/337
8,297,160 B2 10/2012 Friesen et al.
8,402,872 B2 3/2013 Friesen et al.
8,464,976 B2 6/2013 Mok et al.
8,555,761 B2 * 10/2013 Keily ..... B26D 1/125 83/343
8,733,218 B2 5/2014 Hansen et al.
8,740,129 B2 6/2014 Keily et al.
8,807,475 B2 * 8/2014 Rodrian ..... A47K 10/36 242/563.2
8,919,233 B2 * 12/2014 Lewis ..... B26D 5/00 225/39
8,943,938 B2 * 2/2015 Sahlberg ..... B65H 35/0006 83/295
9,326,647 B2 * 5/2016 Larson ..... A47K 10/36
2001/0045149 A1 * 11/2001 Granger ..... A47K 10/36 83/335
2002/0096028 A1 7/2002 Morand
2003/0164079 A1 * 9/2003 Budz ..... A47K 10/36 83/649
2007/0194166 A1 * 8/2007 Reinsel ..... A47K 10/36 242/563
2011/0168831 A1 7/2011 Mok et al.
2014/0116216 A1 5/2014 Morand

* cited by examiner

PAPER TOWEL DISPENSER

FIELD

The present disclosure relates to paper towel dispensers for rolls of paper toweling.

BACKGROUND

The following U.S. Patents and Publications are incorporated herein by reference in entirety:

U.S. Pat. No. 4,712,461 discloses a dispenser for rolls of flexible sheet material has a feed roller with a pair of pinch rollers spaced around the feed roller periphery to guide a web of the material from a supply roll to the dispenser exit. A cutting blade is slidably mounted within the feed roller to move in a path parallel to and offset from a radius of the feed roller with cam followers movable with the blade and extending beyond the ends of the feed roller disposed to reciprocate along this radius. Stationary cams are mounted adjacent the ends of the feed roller engaged with the cam followers, respectively, to positively project the blade cutting edge beyond the feed roller periphery to cut the web and retract such edge as the feed roller is rotated by drawing on the web at the dispenser exit.

U.S. Pat. No. 6,736,348 discloses a paper towel dispenser which provides for hands free, automatic feeding of the first sheet of a primary web roll, such as a paper towel roll, into a feed mechanism when its cover is closed. The dispenser also automatically transfers its web feed supply from a primary roll to a reserve roll upon the exhaustion of the primary roll. The patented disclosure eliminates the need for an attendant to thread the leading edge of a primary or reserve roll into the feed mechanism of the dispenser. The dispenser also eliminates wasted paper because it does not begin to feed the reserve roll until the primary roll has expired. The dispenser can include either a manual feed mechanism or a powered feed mechanism. The dispenser relies on a sensor for determining when a portion of the web is absent from a side of the feed mechanism proximate a web discharge opening. When such an absence is sensed, an automatic, powered web transfer mechanism contacts the web located in front of the feed mechanism and positions it between the rollers of the feed mechanism. The transfer mechanism includes a web transfer member and a motor for driving the transfer member in the direction of the feed mechanism. The dispenser also includes a retraction mechanism for returning the transfer bar to a rest position after the web has been introduced into the feed mechanism.

U.S. Pat. No. 7,500,420 discloses a dispenser apparatus for dispensing paper toweling. The dispenser includes structure for damping forces applied to a roll of paper toweling when overspin slack is taken up and modifying cutter blade timing to reduce peak pull force during dispensing. A biased damping roller is displaceable by toweling when the toweling is pulled to take up the slack and maintain the toweling in taut condition.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

Disclosed herein is a paper towel dispenser for dispensing paper toweling from a roll of paper toweling including a housing; a right mechanical side connected to the housing and having a radial cam; a left mechanical side connected to the housing and having a radial cam; a right roll holder connected to the right mechanical side; a left roll holder connected to the left mechanical side; and a drum having an outer circumferential surface. The drum defines an interior space and is operatively connected to the right and left mechanical sides. The drum receives paper toweling from a paper roll located between the right roll holder and left roll holder, and the paper toweling contacts the outer circumferential surface of the drum and rotates with the drum as a pulling force is applied to the leading edge of the paper toweling. The paper towel dispenser of the present application also includes a blade assembly having two terminal ends and a blade located in the interior space of the drum. The blade assembly is pivotally movable within the interior space of the drum. The blade assembly moves from a first blade position where the blade is fully contained within the interior space of the drum to a second blade position where the blade protrudes beyond the outer circumferential surface of the drum. The blade assembly moves between the first blade position and second blade position when the drum rotates in response to the pulling force. A top roller having two terminal ends and operably positioned to contact the paper toweling between the paper roll and the drum. The terminal ends positioned in the radial cams of the right mechanical side and the left mechanical side. The top roller moves along the outer circumference of the drum and dampens forces applied to a paper roll when the pulling force is applied to the leading edge of the paper toweling.

The paper towel dispenser may or may not also include at least one tension spring connected to a terminal end of top roller. The tension spring biases the top roller to a first roller position. A paper start pivotally connected to the right mechanical side and left mechanical side pivots to a closed position placing the leading edge of the paper toweling against the drum. At least one paper guide operably connected to the housing and paper toweling moves between the outer circumferential surface of the drum and the paper guide. Alternatively, an indicator operably connected to the housing and having at least two corners is pivotally connected to the housing. The indicator contacts the paper roll and moves along the sloped grove as the paper towel roll is depleted.

Also disclosed is a paper towel dispenser for dispensing paper toweling from a roll of paper toweling that includes a housing; a right mechanical side connected to the housing and further including a rotational plate. The rotational plate has a rotational cam and an adjustment cam. The paper towel dispenser also includes a left mechanical side connected to the housing, and also includes a rotational plate with a rotational cam and adjustment cam as described above. A right roll holder is connected to the right mechanical side and a left roll holder is connected to the left mechanical side. A drum having an outer circumferential surface with an interior space is operatively connected to right and left mechanical sides. The drum receives paper toweling from a paper roll located between the right roll holder and left roll holder. The paper toweling contacts the outer circumferential surface of the drum and rotates with the drum as a pulling force is applied to the leading edge of the paper toweling. A blade assembly two terminal ends and a blade is located in the interior space of the drum. The blade assembly is pivotally movable within the interior space of the drum, such that the blade assembly moves from a first blade position where the blade is fully contained within the interior space of the drum to a second blade position where the blade protrudes beyond the outer circumferential surface of the drum. The blade assembly moves between the first blade position and the second blade position when the drum rotates in response to the pulling force applied to the leading edge of the paper toweling. Each end of the blade assembly is positioned in and follows the rotational cams of the right mechanical side and left mechanical side. The paper toweling moves to the second blade position and cuts the paper toweling when the pulling force is applied. At least one set fastener setting the position of the rotational plates of the right mechanical side and left mechanical side is further included in certain embodiments. The set fastener is removably connected to the right mechanical side and the left mechanical side through the adjustment cam. The rotational plates may be rotated to adjust the location of the first position and the second position of the blade assembly.

BRIEF DESCRIPTION OF THE DRAWINGS

Examples of the paper towel dispenser are described with reference to the following figures. The same numbers are used throughout the figures to reference like features and components.

DETAILED DESCRIPTION

In the present description, certain terms have been used for brevity, clearness, and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives, and modifications are possible within the scope of the appended claims.

Figure 1:
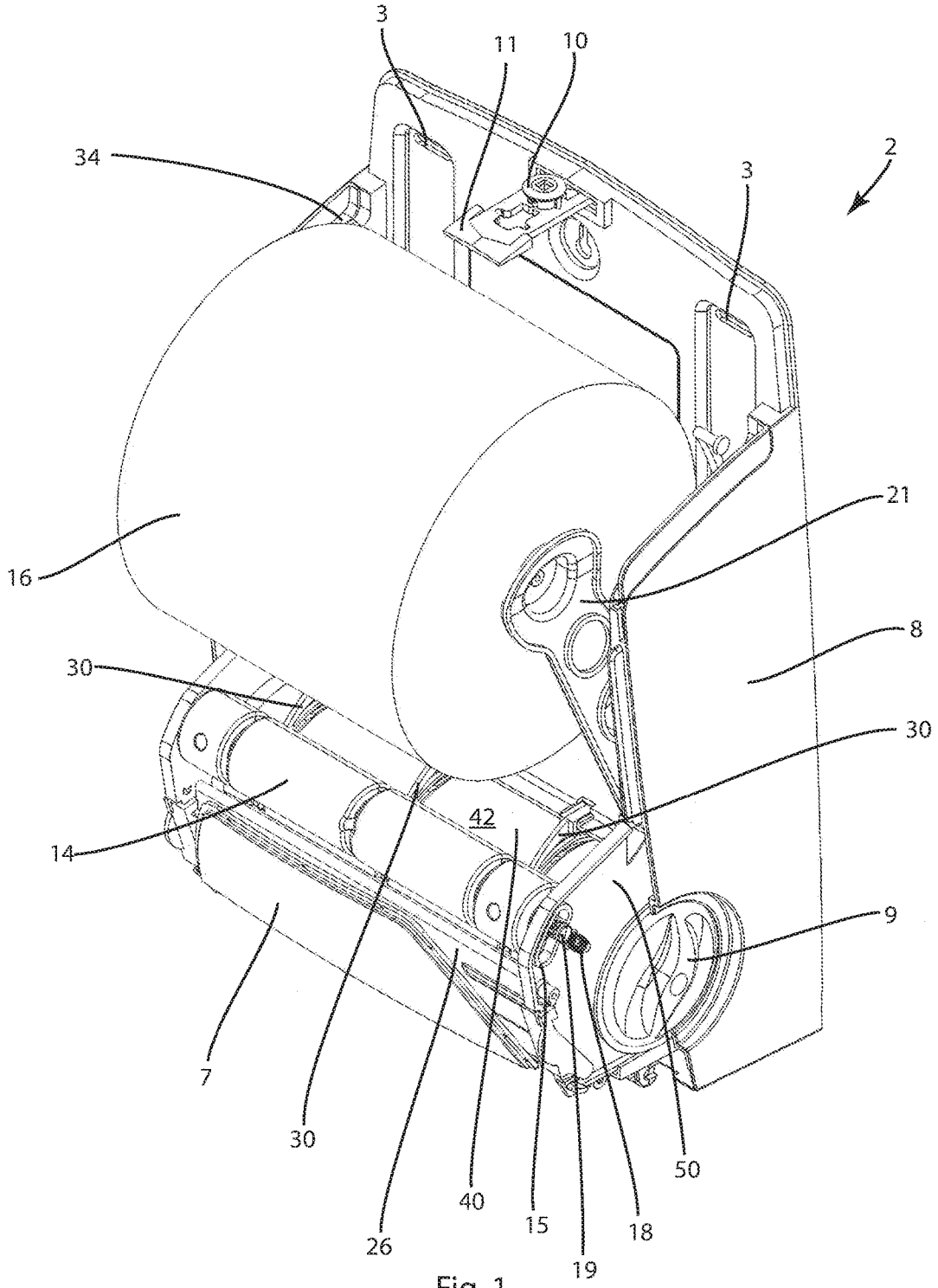
FIG. 1 depicts a front perspective view of an exemplary embodiment of the paper towel dispenser.
Figure 2:
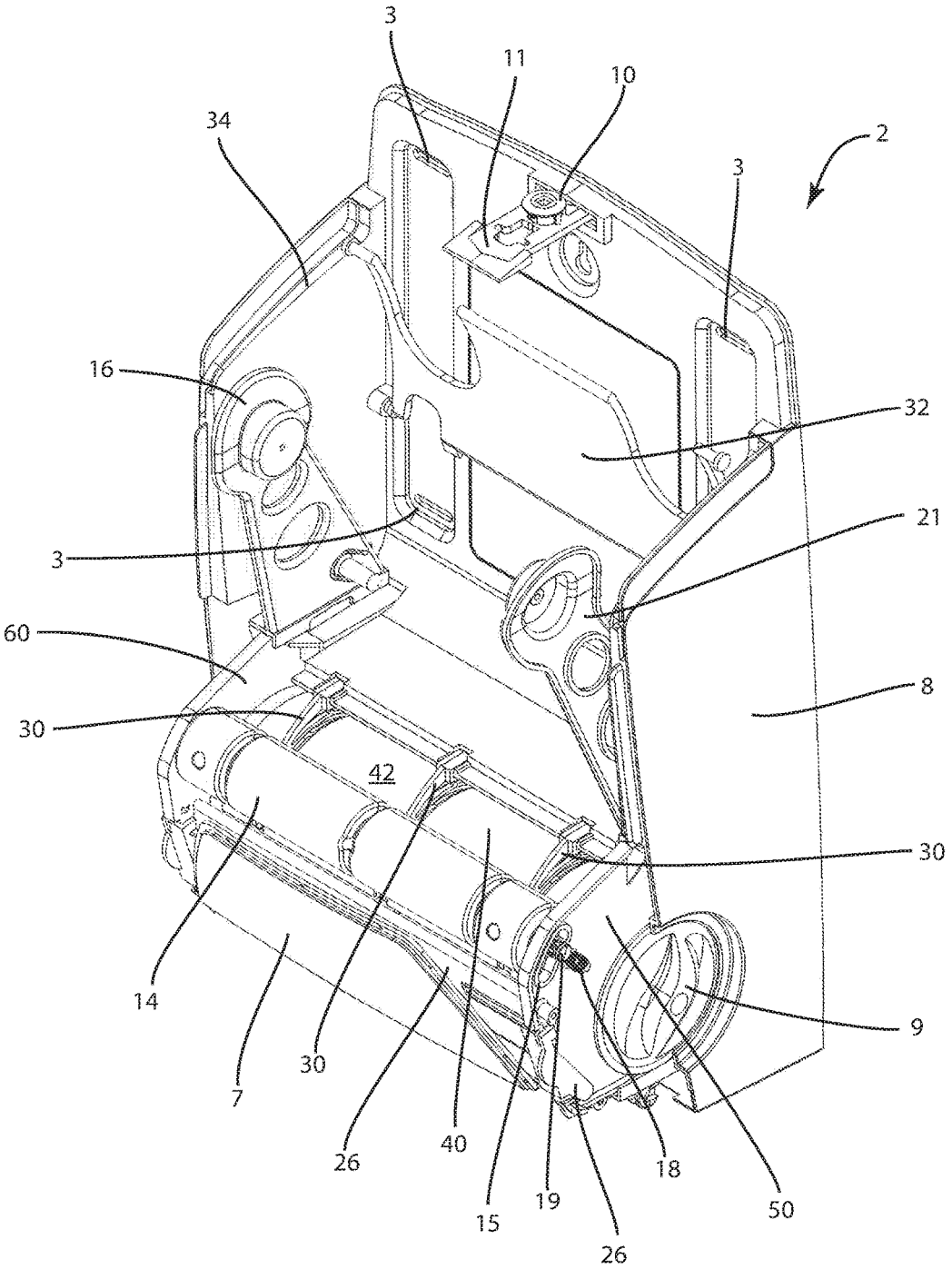
FIG. 2 depicts a front perspective view of the paper towel dispenser of FIG. 1 excluding the paper towel roll.
Figure 3:
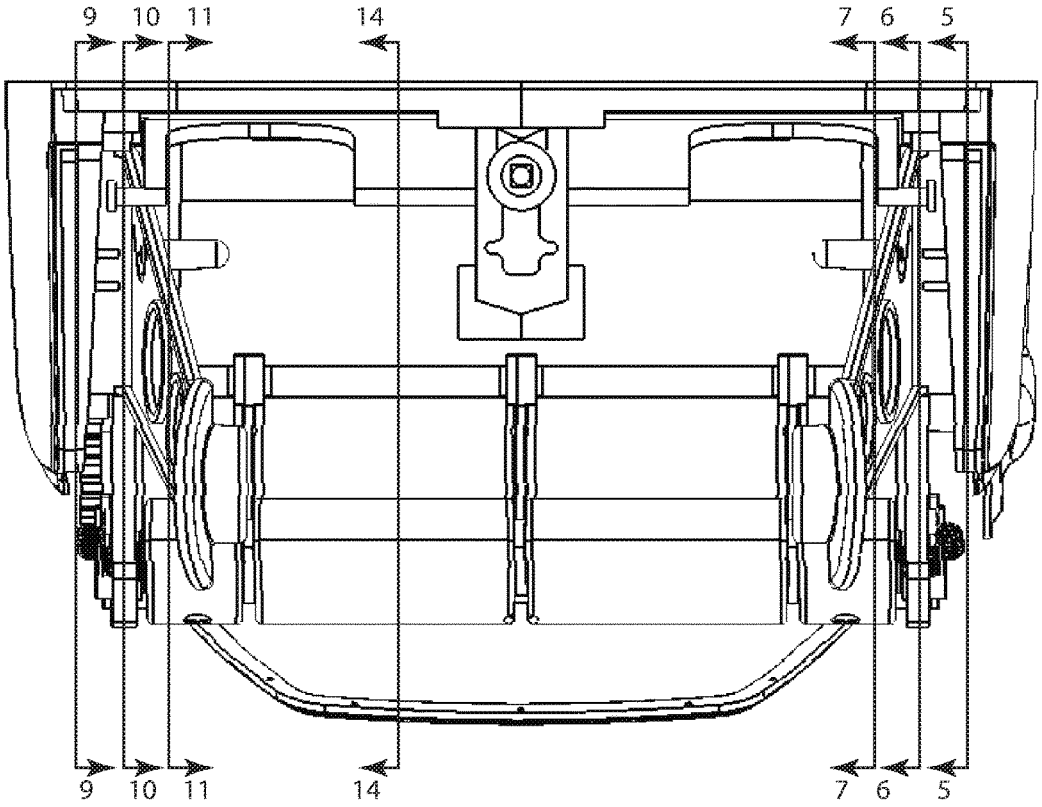
FIG. 3 depicts a top view of the paper towel dispenser of FIG. 2 showing section view lines for figures herein.
Figure 4:
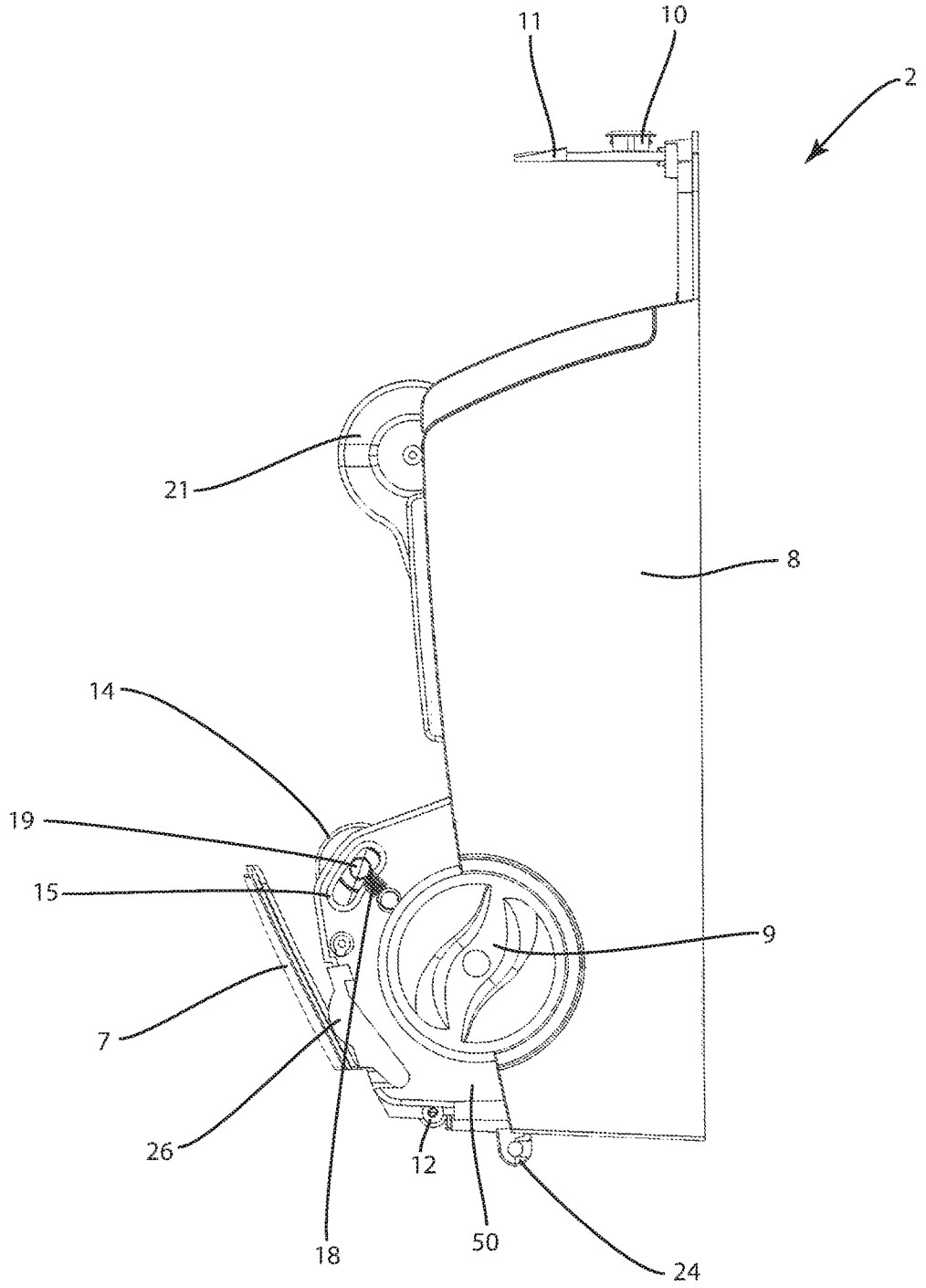
FIG. 4 depicts a right side view of the paper towel dispenser of FIG. 2.
Figure 5:
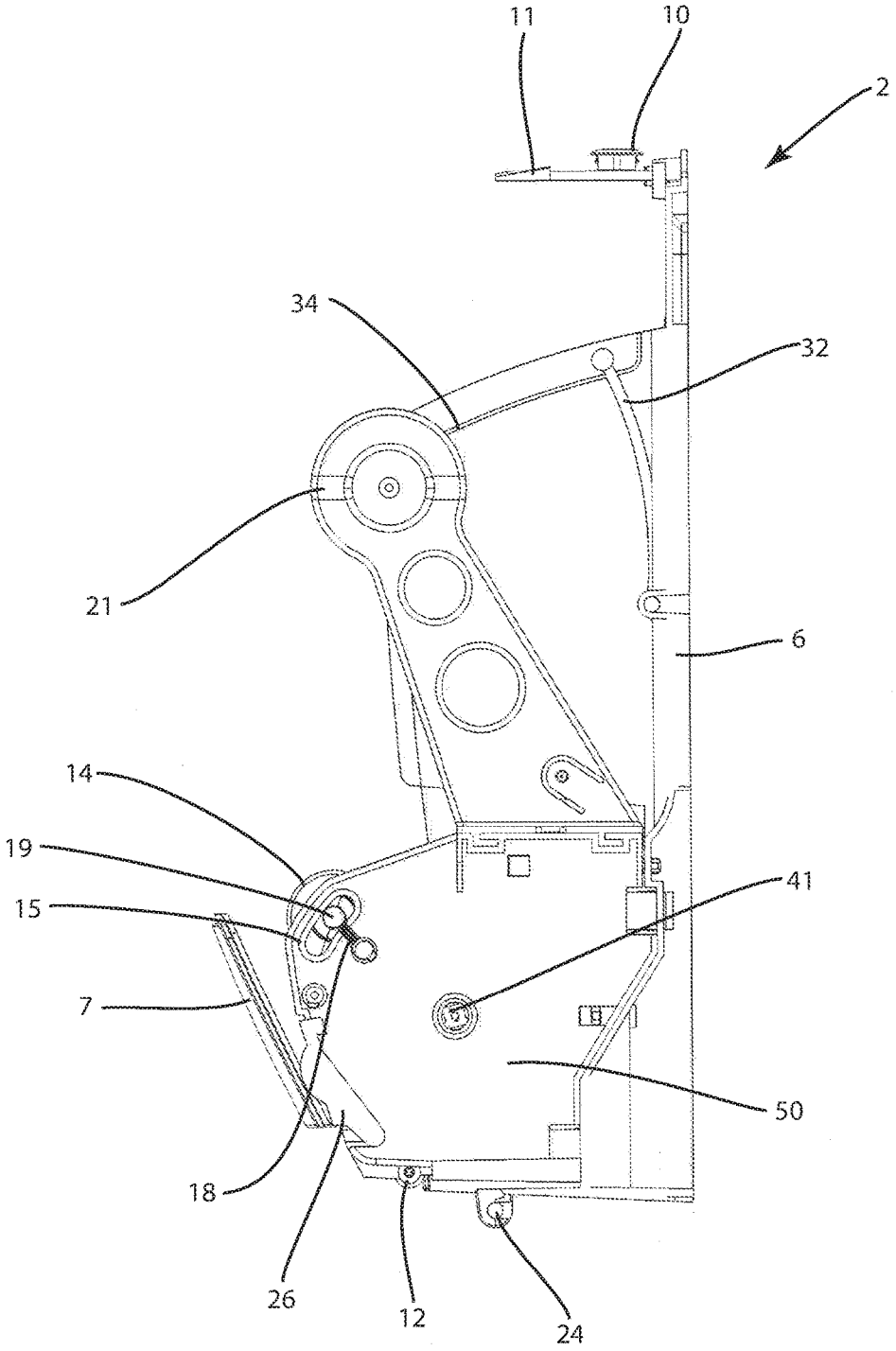
FIG. 5 depicts a cross sectional view of the paper towel dispenser along line 5-5.
Figure 6:
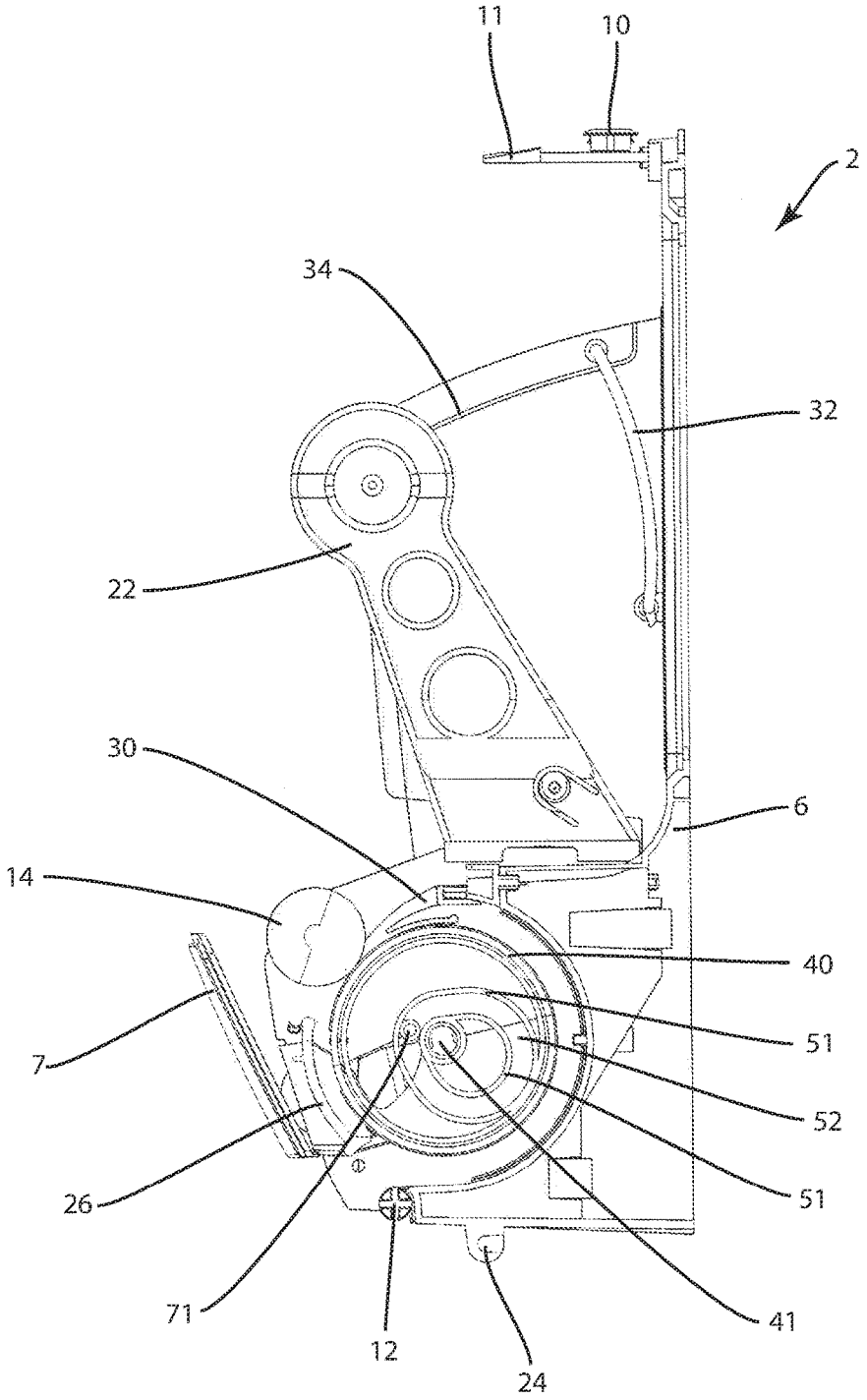
FIG. 6 depicts a cross sectional view of the paper towel dispenser along 6-6.
Figure 7:
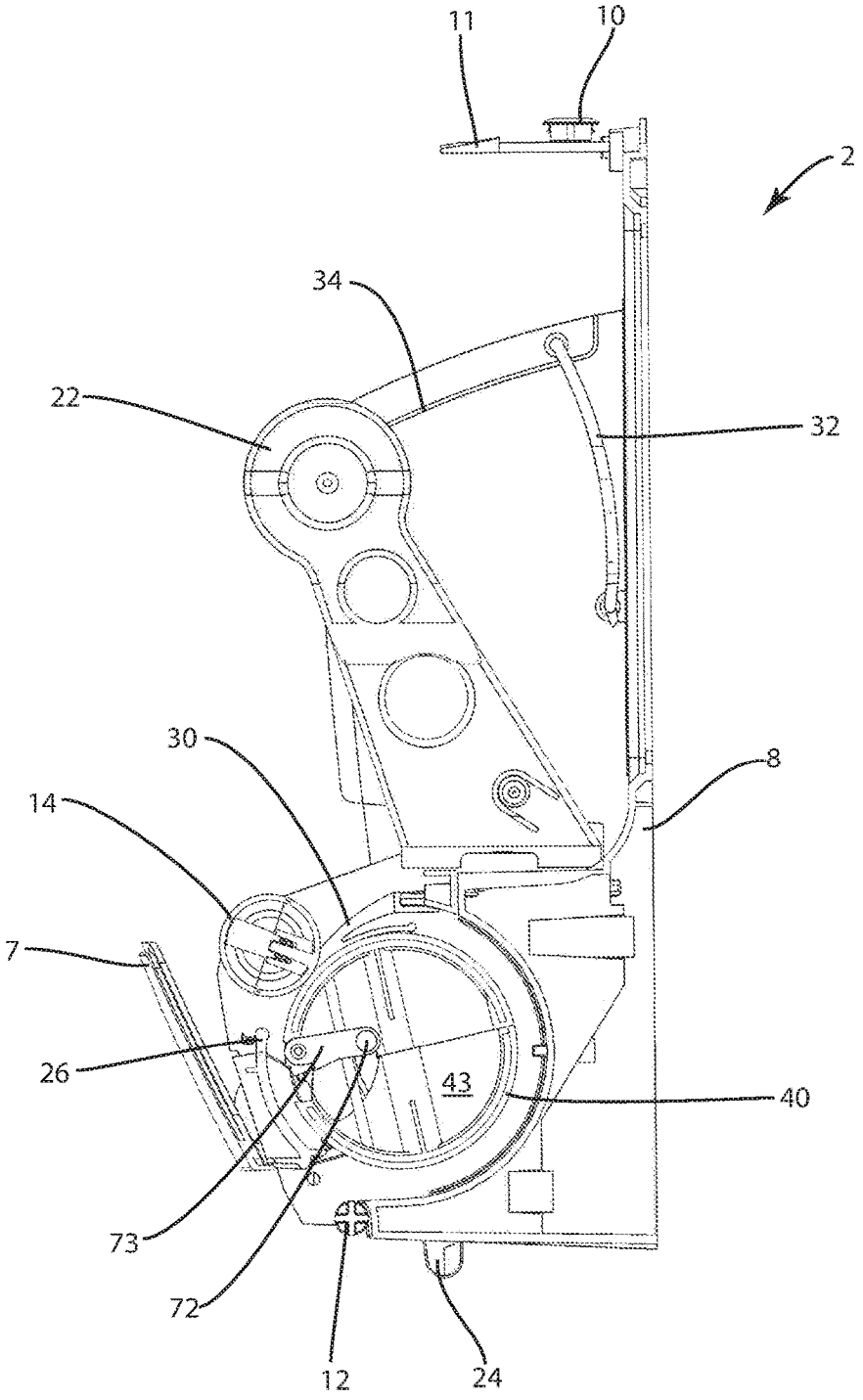
FIG. 7 depicts cross sectional view of the paper towel dispenser along 7-7.
Figure 8:
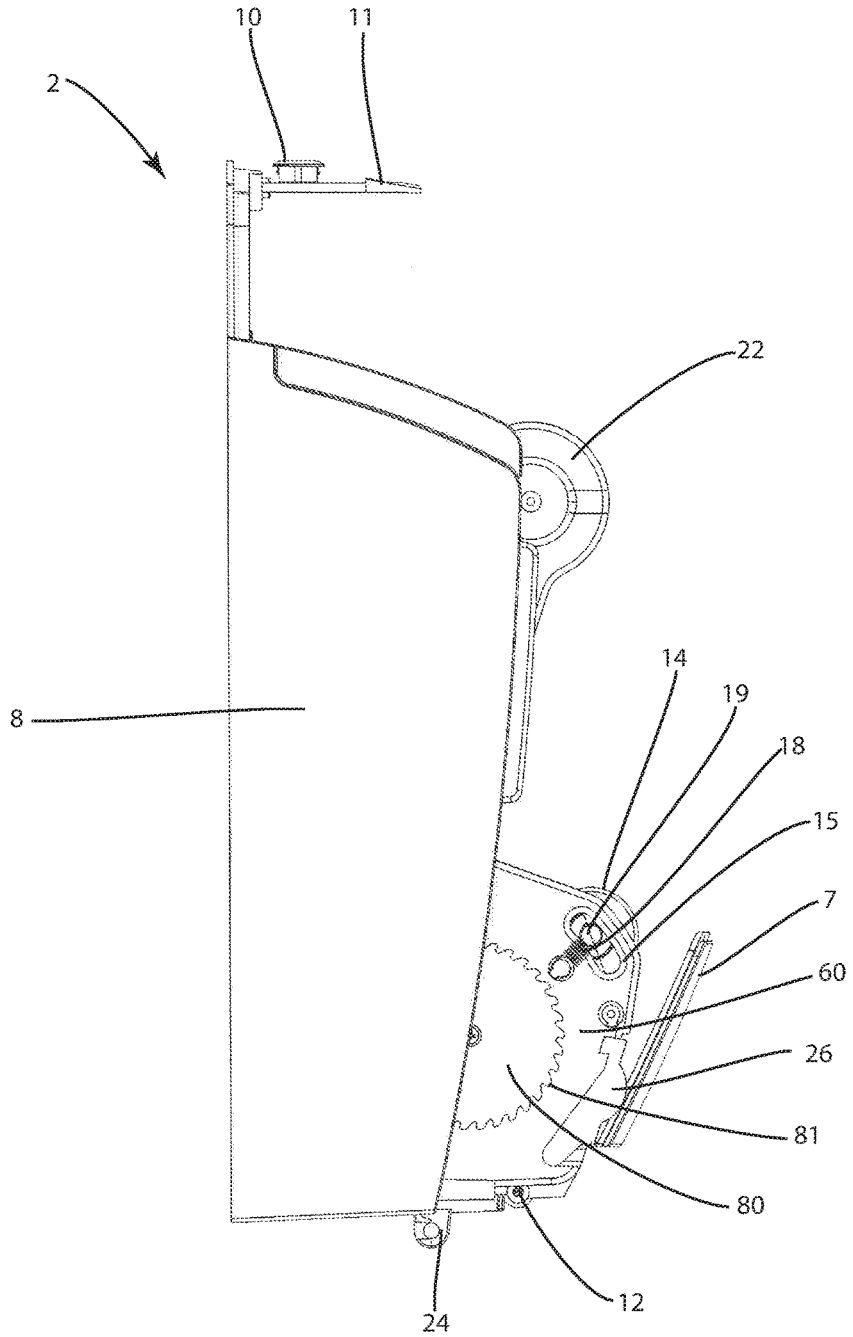
FIG. 8 depicts a left end view of the paper towel dispenser FIG. 2.

FIGS. 1-14 depict an exemplary embodiment of a paper towel dispenser 2 and components thereof. Turning first to FIGS. 1-2, the exterior enclosure of the paper towel dispenser 2 comprises a cover (not shown), a cover logo plate 7, a housing 8, and a feed wheel 9. The cover is not shown in the figures so that the interior components of the paper towel dispenser 2 are visible. In operation, the cover would be positioned on the paper towel dispenser 2 such that the interior components of the paper towel dispenser 2 are guarded from exterior elements and debris as is well known in the art. The cover may be held on the paper towel dispenser by a lock cap 10 and a lock 11. The lock 11 can be actuated by a key or other functional means.

Figure 14:
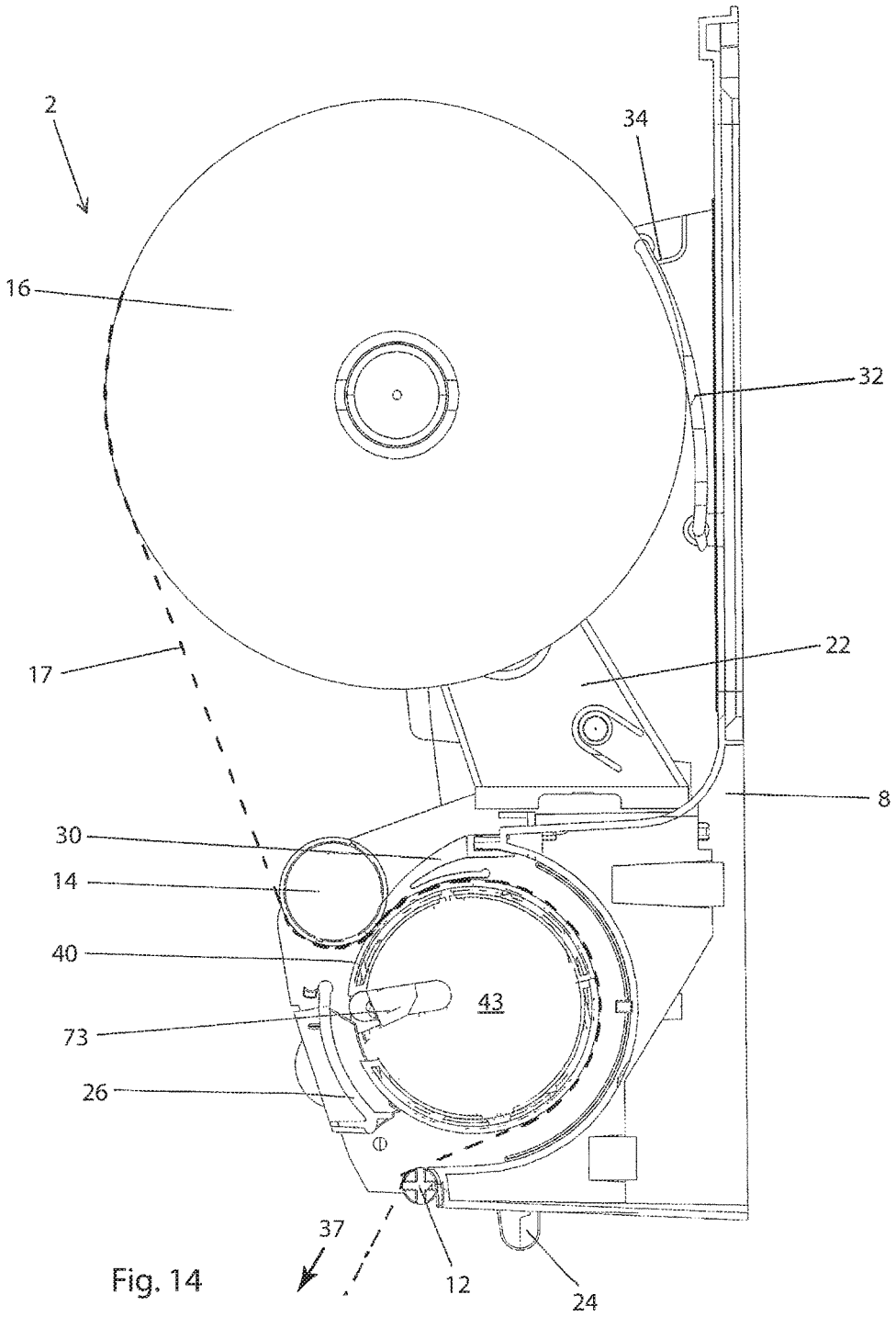
FIG. 14 depicts a cross sectional view of the paper towel dispenser along 14-14.
Figure 15:
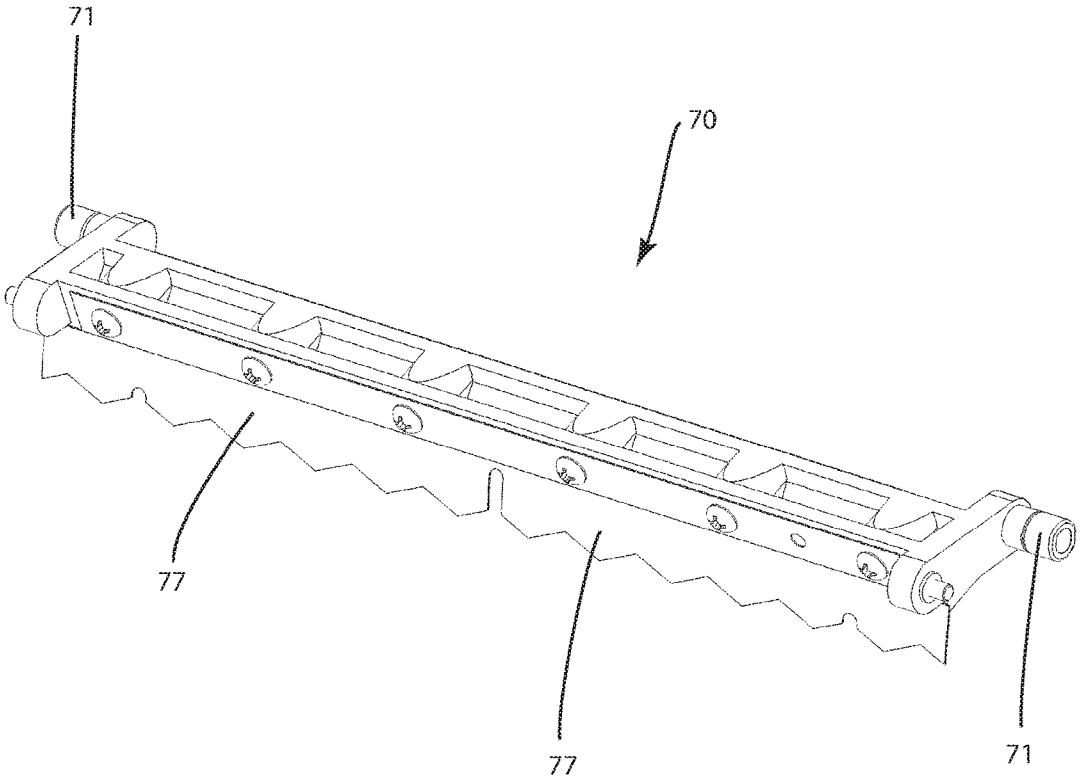
FIG. 15 depicts a front perspective view of the blade assembly of the paper towel dispenser in FIG. 1.

The housing 8 defines the rear and side portions of the paper towel dispenser 2. The housing 8 includes mounting holes 3 so that the paper towel dispenser 2 can be mounted to a surface, such as a wall. The logo plate 7 may be included as part of the cover or the housing 8. The cover logo plate 7 may be embossed or engraved with indicia or allow for the attachment of a sticker or adhesive element by the user. A feed wheel 9 is located on the side of the paper towel dispenser 2 to allow the user the ability to manually rotate a drum 40 so that the leading edge of the paper towel exits the paper towel dispenser 2. The paper toweling path 17 through the paper towel dispenser 2 is depicted in FIG. 14.

A right mechanical side 50 and a left mechanical side 60 are connected to the housing 8 and have radial cams 15. The right mechanical side 50 and left mechanical side 60 may also be fitted with other holes, channels, cams, tabs, and the like for connecting other components, further described herein, to the right mechanical side 50 and the left mechanical side 60.

A right roll holder 21 is connected to the right mechanical side 50, and a left roll holder 22 is connected to the left mechanical side 60. A paper roll 16 is located between the right roll holder 21 and the left roll holder 22 such that the paper roll 16 is suspended above the right mechanical side 50 and left mechanical side 60. The right roll holder 21 and left roll holder 22 are preferably made of material that allows the right roll holder 21 and/or left roll holder 22 to elastically deform during insertion or removal of the paper roll 16.

As shown in FIGS. 1-2, 6-7, and 10-11, a drum 40 comprising an outer circumferential surface 42 and a center 41 defining an interior space 43 is operatively connected to the right mechanical side 50 and the left mechanical side 60. The drum 40 receives paper toweling from the paper roll 16 located between the right roll holder 21 and the left roll holder 22 and the paper toweling contacts the outer circumferential surface 42 of the drum 40. The paper toweling and the drum 40 rotate as a pulling force is applied to the leading edge of the paper toweling. In the exemplary embodiment, the drum 40 rotates clockwise while in operation. Those skilled in the art with recognize that the drum 40 may rotate counterclockwise. In the exemplary embodiment, the paper toweling moves around the rear of the drum 40 (see FIG. 14).

Figure 16:
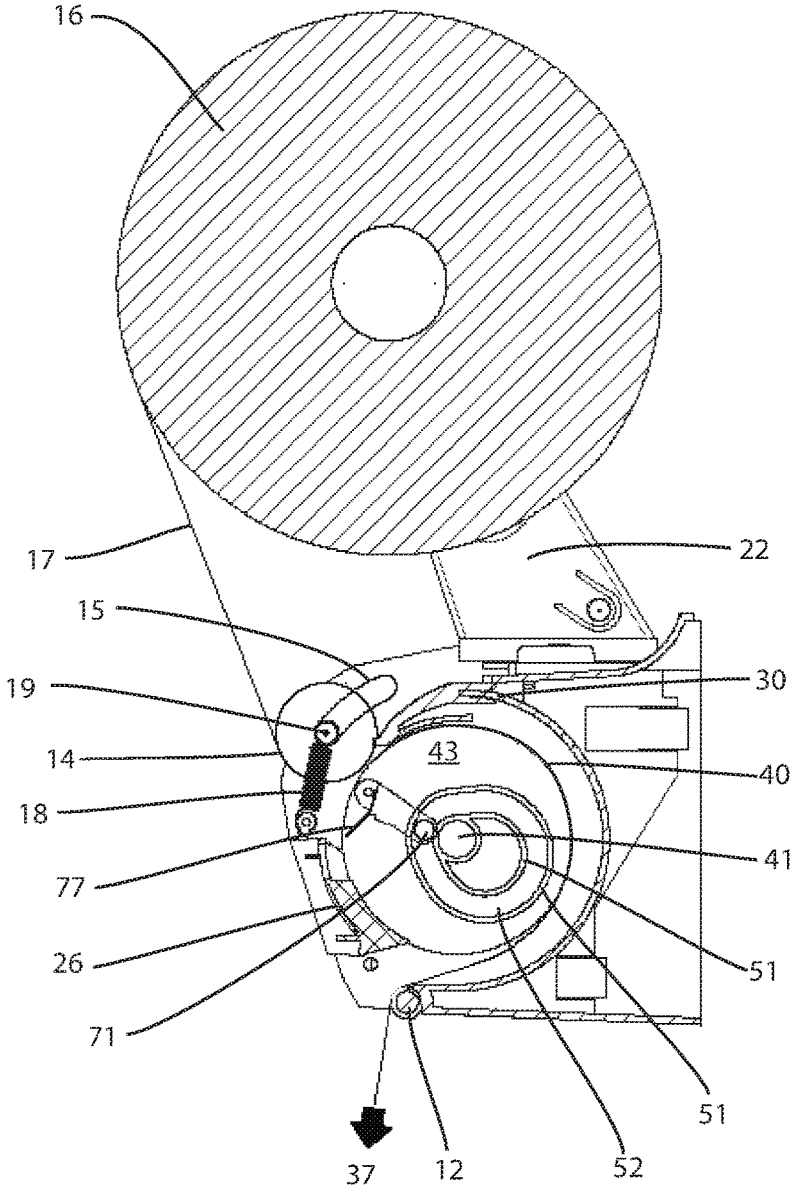
FIG. 16 depicts the blade assembly in the drum at the first blade position.

As shown in FIGS. 6-7, 10-11, 12, and 14-15, a blade assembly 70 is located in an interior space 43 defined by the drum 40. The blade assembly 70 comprises two terminal ends 71 and at least one blade 77. The blade assembly 70 is pivotally movable within the interior space 43 defined by the drum 40 and the blade assembly 70 moves between a first blade position (see FIG. 16) and a second blade position (see FIG. 17). In the first blade position (FIG. 16), the blade 77 is fully contained within the interior space 43 defined by the drum 40. The blade assembly 70 is in the first blade position (FIG. 16) when a pulling force 37 is not applied to the leading edge of the paper toweling. In the second blade position (FIG. 17), the blade 77 protrudes outwardly from the outer circumferential surface 42 of the drum 40 to cut the paper toweling. The blade assembly 70 moves from the first blade position (FIG. 16) to the second blade position (FIG. 17) when the drum 40 rotates in response to the pulling force 37 applied to the leading edge of the paper toweling. The blade assembly 70 completes a full rotation with the drum 40 and returns to the first blade position (FIG. 16). In this manner, the paper toweling is cut from the paper roll 16 and may be detached by a user.

Figure 17:
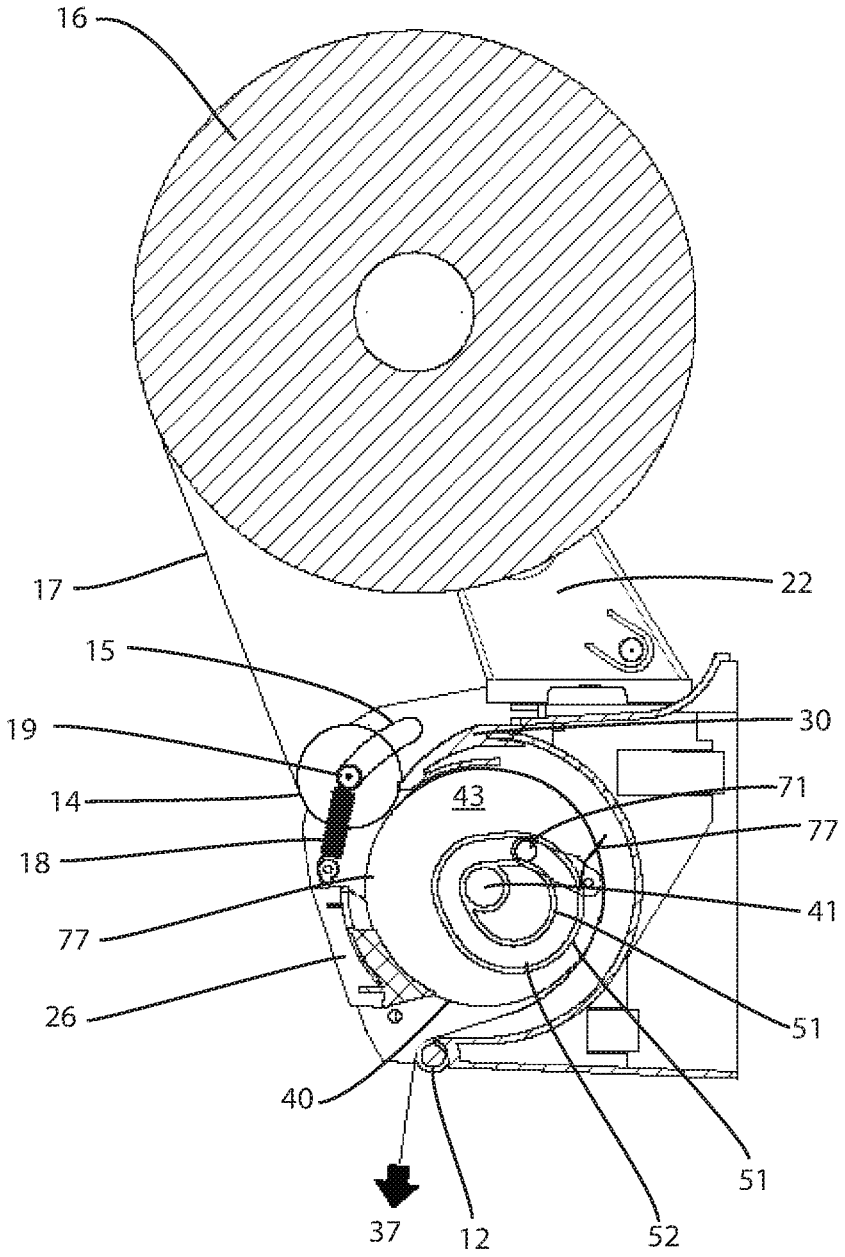
FIG. 17 depicts the blade assembly in the drum at the second blade position.
Figure 18:
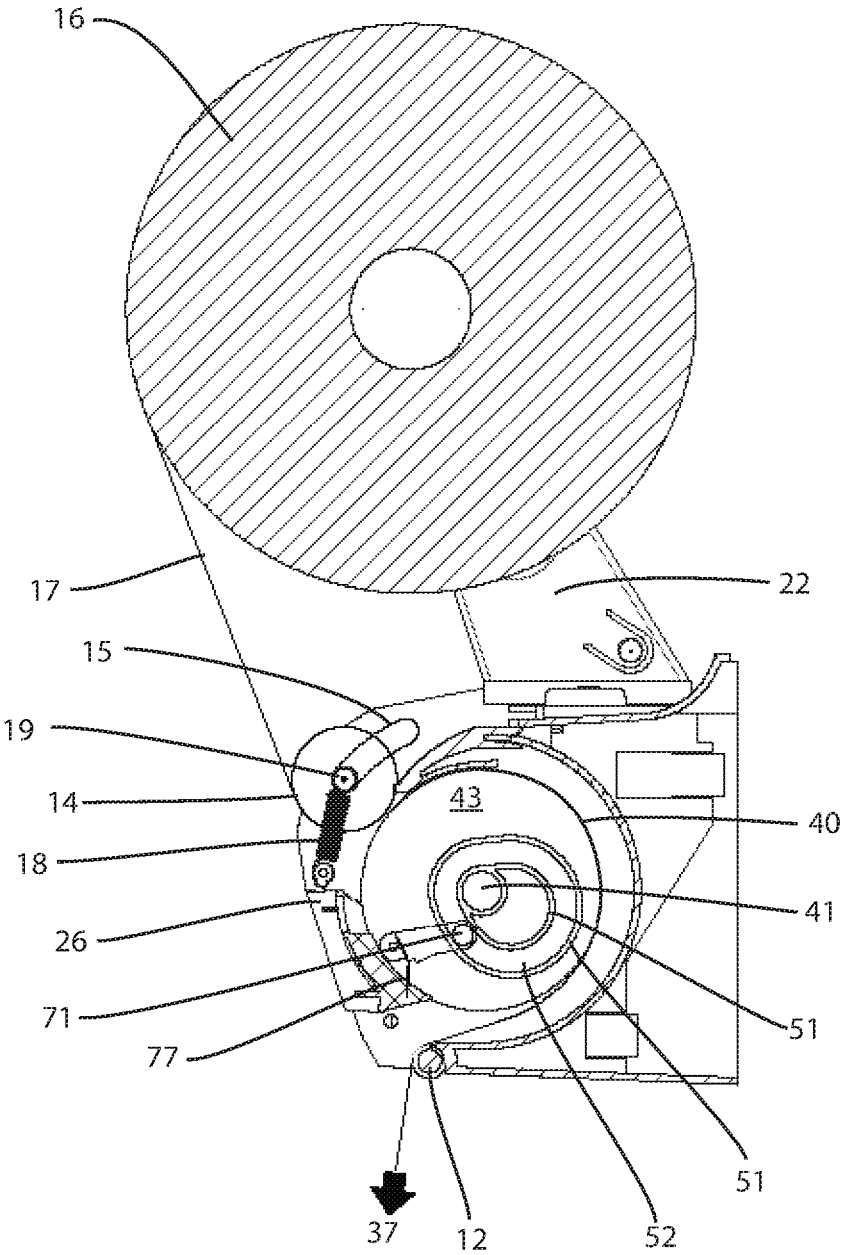
FIG. 18 depicts the blade assembly in the drum at a position between the first blade position and the second blade position.

The right mechanical side 50 and left mechanical side 60 may also include rotational cams 52, 62. The rotational cams 52, 62 have at least two channels 51, 61. The terminal ends 71 of the blade assembly 70 are positioned in the rotational cams 52, 62 of the right mechanical side 50 and the left mechanical side 60 such that the blade assembly 70 follows the rotational cams 52, 62 and the blade assembly 70 is guided between the first blade position (FIG. 16) and second blade position (FIG. 17).

Figure 12:
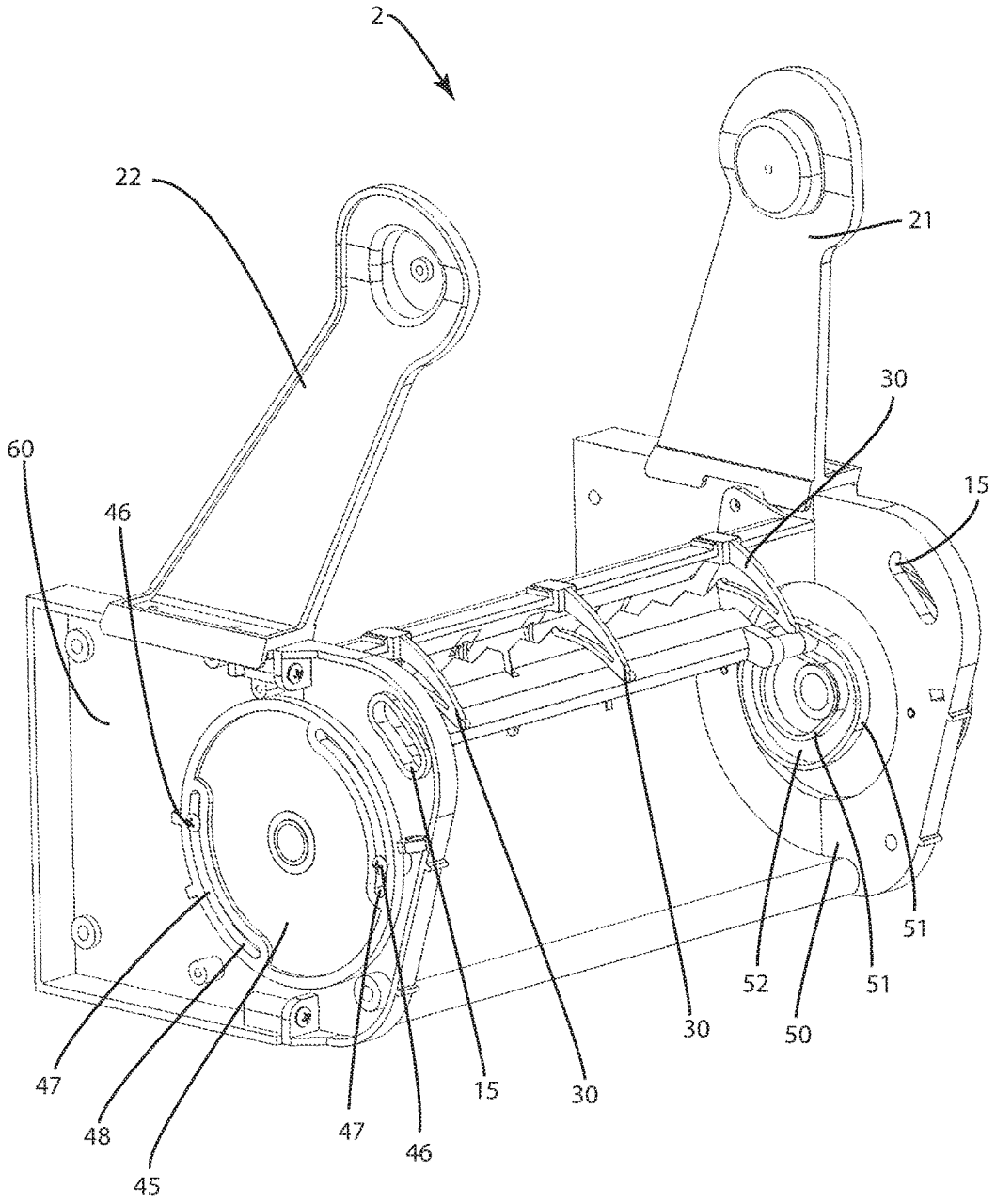
FIG. 12 depicts a front perspective view of an alternate embodiment of the paper towel dispenser excluding the paper towel roll, housing, and cover.
Figure 13:
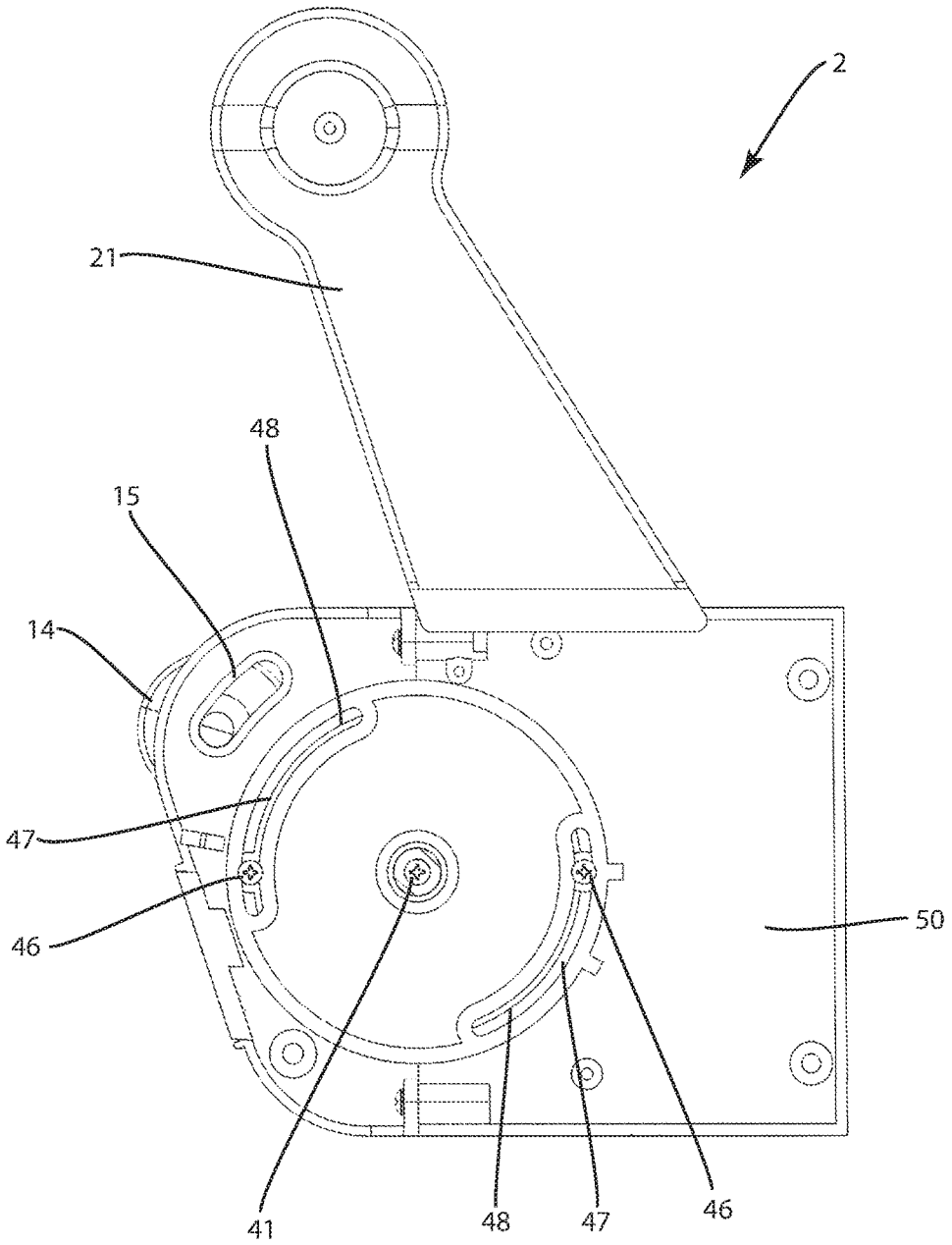
FIG. 13 depicts a right end view of the paper towel dispenser in FIG. 12.

In another embodiment of the present disclosure, shown in FIGS. 12-13, the right mechanical side 50 and the left mechanical side 60 further include rotational plates 45. The rotational plate 45 may comprise the rotational cams 52, 62 and at least one adjustment cam 47. The adjustment cams 47 define at least one slot 48. At least one set fastener 46 for setting the position of the rotational plates 45 on the right mechanical side 50 and the left mechanical side 60. The set fasteners 46 are removably connected to the right mechanical side 50 and the left mechanical side 60 and may pass through slots 48 in the rotational plates 45. In operation, the rotational plates 45 are rotated by a user to rotate the cams 52, 62 which subsequently adjusts the first blade position (FIG. 16) and the second blade position (FIG. 17) of the blade assembly 70 as the blade assembly 70 rotates with the drum 40 under pulling force 37 on the leading edge of the paper toweling. The ability to rotate the rotational plates 45 is advantageous because of the different elasticities and tensile strengths of paper toweling. Furthermore, the characteristics of the paper toweling may vary between manufacturers and supplier. Rotating the rotational plates 45 allows the user to account for paper toweling differences and ensure that the blades 77 cut the paper toweling at the correct position maintaining optimum dispensing when the pulling force 37 is applied to the leading edge of the paper toweling.

In operation, a maintenance worker may remove and/or rotate the rotation plate 45 to a desired position along the adjustment cams 47. Once the desired position is reached, the rotation plates 45 are secured by the set fasteners 46 through slots 48 in the rotational plates 45 to the right mechanical side 50 and left mechanical side 60.

Turning to FIGS. 1-2, 6-7, 10-11, and 14, a top roller 14 is operably positioned to contact the paper toweling between the paper roll 16 and the drum 40. The top roller 14 has two terminal ends 19. The terminal ends 19 are positioned in radial cams 15 of the right mechanical side 50 and left mechanical side 60 forward of the vertical centerline of the drum 40. The radial cams 15 cause the top roller 14 to move about the drum 40 along an outer circumferential surface 42 of the drum 40 and prevent the top roller 14 from moving toward or away from the drum 40. The top roller 14 dampens forces applied to the paper roll 16 when the pulling force 37 is applied to the leading edge of the paper toweling. The top roller 14 also maintains the paper toweling between the paper roll 16 and the drum 40 in a taut condition until the paper toweling is cut by the blade 77. The top roller 14 rotates and translates along the path of the radial cams 15, and the radial cams 15 are shaped to prevent the top roller 14 from moving toward or away from the center 41 of the drum 40.

In some embodiments, at least one tension spring 18 may be connected to the terminal end 19 of the top roller 14 and the right mechanical side 50 or the left mechanical side 60. In a first position, the tension spring 18 biases the top roller 14 to a first roller position. In a second position, the tension spring 18 biases the top roller 14 to the center of the radial cam 15. In operation the user applies a pulling force 37 to leading edge of the paper toweling causing the paper toweling to move the top roller 14 along the path of the radial cam 15. The movement of the top roller 14 is restrained by the radial cam 15. Tension springs 18 connected to the terminal ends 19 of the top roller 14 apply a return force to the top roller 14 such that when the paper toweling is cut by the blade 77 of the blade assembly 70 in the drum 40, the top roller 14 is forced back to its first position in the radial cam 15 by the tension spring 18. Therefore, the force applied by the tension spring 18 operates to alleviate shock and dampen the forces in the paper toweling between the paper roll 16 and drum suspended above the drum 40 by the right roll holder 21 and the left roll holder 22.

Turning now to FIGS. 1-2, 4-11, and 14, a paper start 26 is pivotally connected to the right mechanical side 50 and left mechanical side 60. The paper start 26 pivots from an open position to a closed position. In operation, the paper start 26 assists the loading of the paper towel dispenser 2. To load the dispenser 2, the leading edge of the paper toweling is pulled down from the paper roll 16 and inserted between the drum 40 and paper start 26 while the paper start 26 is in an open position. The paper start 26 is pivoted to the closed position, by the user or other means, causing the paper toweling to make contact with the drum 40. As the feed wheel 9 is actuated, the drum 40 rotates causing the paper toweling to rotate with the drum 40 and pass between the top roller 14 and drum 40. Further actuation of the feed wheel 9 causes the leading edge of the paper toweling to exit the paper towel dispenser 2. In one example, the bottom end of the paper start 26 is pivotally fixed to the right mechanical side 50 and the left mechanical side 60 while the top end is removably fastened to the right mechanical side 50 and the left mechanical side 60 by the operator. To move the paper start 26 to the open position, the operator unfastens the top end of the paper start 26 from the right mechanical side 50 and the left mechanical side 60. In another example, the paper start 26 moves between the open position and closed position when the cover is opened and closed. The bottom end of the paper start 26 is pivotally fixed to the right mechanical side 50 and the left mechanical side 60 and projections or ears on the paper start 26 contact the cover as the cover opens and closes. The paper start 26 moves between the open position and the closed position without the operator contacting the paper start 26. In still another example, the paper start 26 may be attached to the cover such that the when the cover moves to a closed position, the paper start 26 causes the paper toweling to make contact with the drum 40. Thus, when the cover moves to an open position, the paper start 26 also moves to an open position.

Paper guides 30 may also be included and a connected to the housing 8. Alternatively, the paper guides 30 may be connected to the right mechanical side 50 or left mechanical side 60. The paper guides 30 help guide the paper around the drum 40 as the paper toweling is pulled by the user.

As shown in FIGS. 2, 6, 7, 10, 11, and 14, an indicator 32 is connected to the housing 8 to show the current diameter of the paper roll 16. In the exemplary embodiment, the indicator 32 is rectangular shaped, however, it may take any shape. In the exemplary embodiment, two corners of the indicator 32 are pivotally connected to the housing 8. The other two corners of the indicator 32 resides adjacent to a sloped groove 34. As the paper roll 16 is depleted through use by a user, the outer diameter of the paper roll 16 decreases. This decrease in size causes the indicator 32 to move along the sloped grooves 34 towards the center of the paper towel dispenser 2. The movement of the indicator 32 can be observed by a maintenance worker through holes, windows, or transparent sections in the cover. By observing the position of the indicator 32 on the sloped groove 34, the maintenance worker can determine how much paper toweling is remaining on the paper roll 16 without opening the cover of the paper towel dispenser 2.

Figure 9:
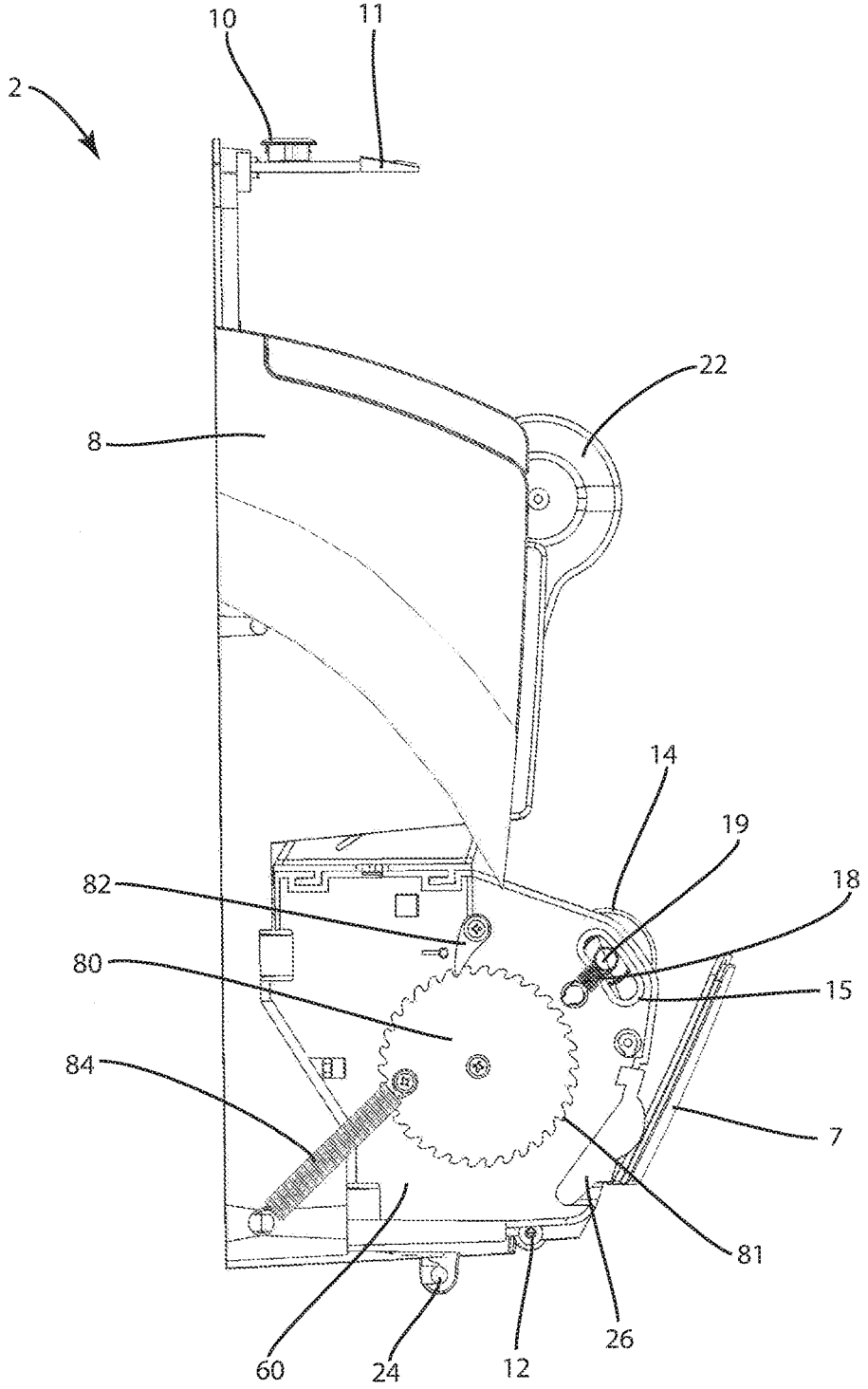
FIG. 9 depicts a cross sectional view of the paper towel dispenser along 9-9.
Figure 10:
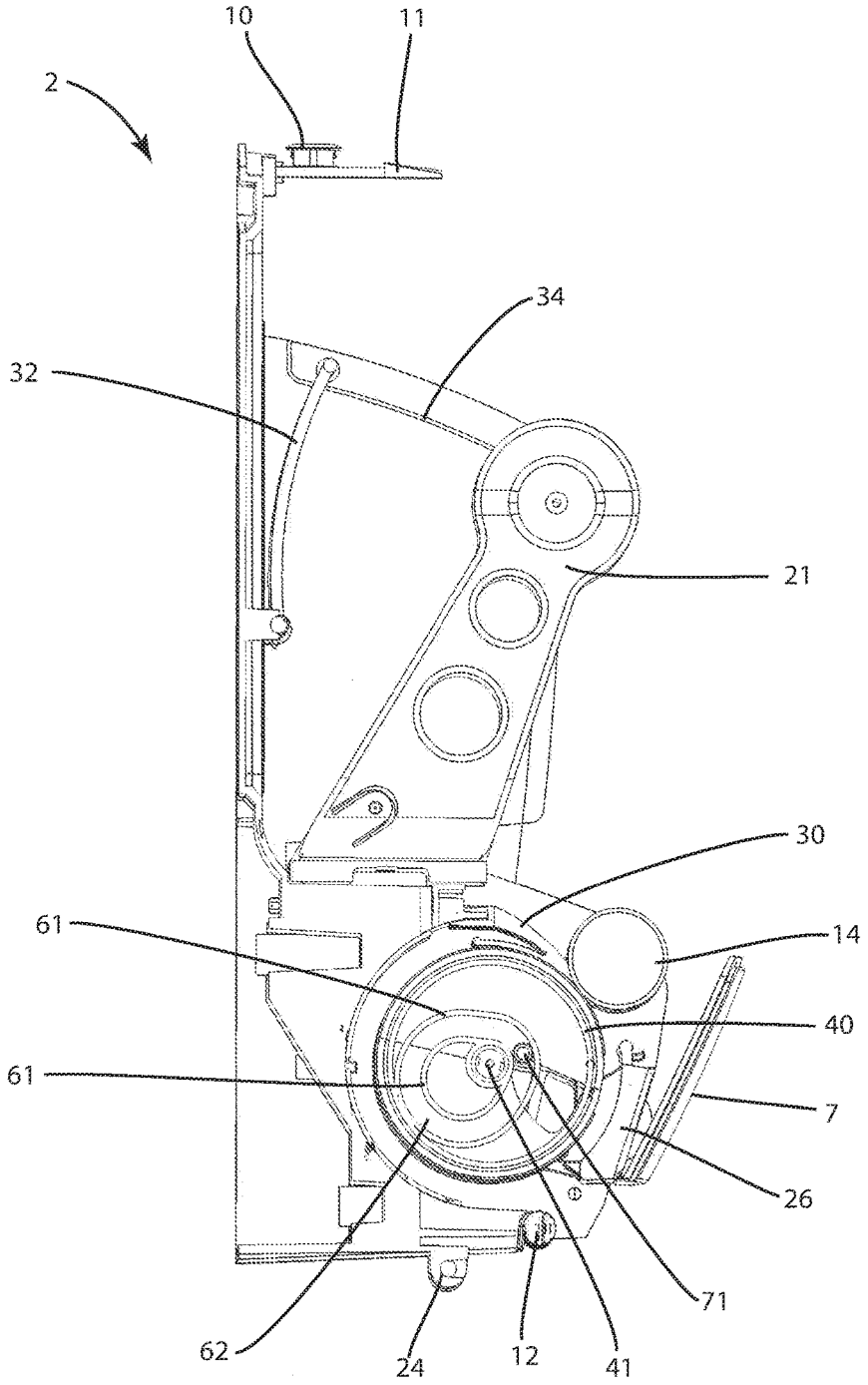
FIG. 10 depicts a cross sectional view of the paper towel dispenser along 10-10.
Figure 11:
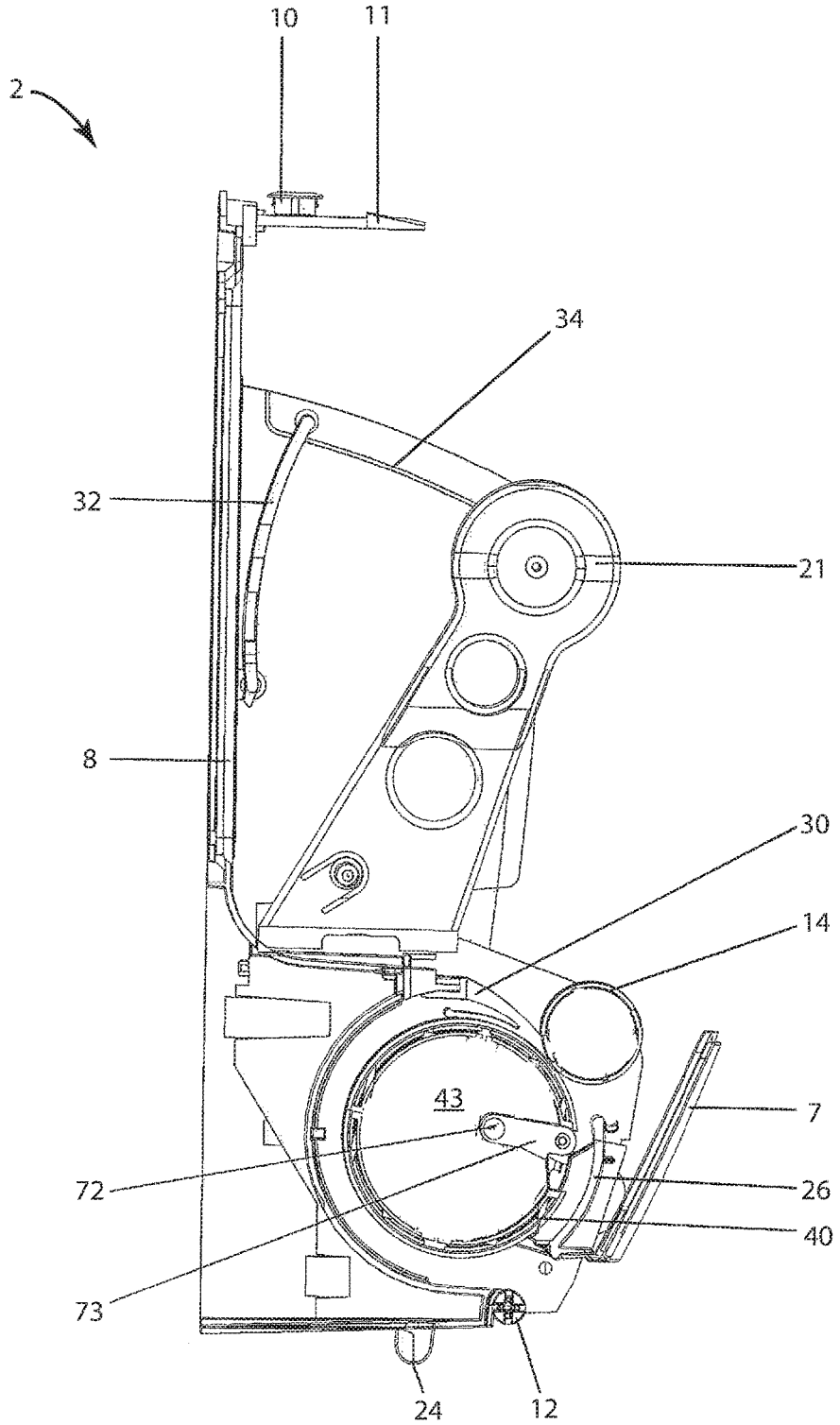
FIG. 11 depicts a cross sectional view of the paper towel dispenser along 11-11.

As shown in FIGS. 4-11, a bottom roller 12 is operably connected to the right mechanical side 50 and left mechanical side 60. In operation, the bottom roller 12 rotates as paper toweling moves past the bottom roller 12 under the pulling force 37 applied to the leading edge of the paper toweling. A bottom roller 12 prevents tearing of the paper toweling at the bottom of the paper towel dispenser Turning to FIGS. 8 and 9, pawl 82 and drive spring 84 are operably connected to the left mechanical side 60. Furthermore, a spring wheel 80 comprising cog teeth 81 is connected to the drum 40. FIG. 9 depicts the spring wheel 80 connected to the center 41 of the drum 40. In operation, the spring wheel 80 rotates with the drum 40. The pawl 82 is positioned adjacent to the spring wheel 80 and operates to engage the cog teeth 81. The pawl 82 is orientated to resist rotation of the spring wheel 80 in one direction while allowing the spring wheel 80 to move in the opposite direction.

The drive spring 84 is connected to the spring wheel 80 and biases the spring wheel 80 toward a rest position. As the leading edge of the paper toweling is pulled by a user, the drum 40 and spring wheel 80 rotate causing the drive spring 84 to stretch and rotate with the drive spring 84. Once the spring wheel 80 rotates past a half revolution, drive spring 84 adds additional rotational force to the spring wheel 80 as the spring returns to its unstretched orientation in the final half revolution as the drive spring 84 returns to its rest position.

As shown in FIGS. 4-11, a cover hinge 24 is located at the bottom of the cover and housing 8. The cover and housing 8 are operably attached to the cover hinge 24. The cover may be rotated downward and away from the center of the paper towel dispenser 2 about the centerline of the cover hinge 24.

Those skilled in the art will appreciate variations of these embodiments not filed within the scope of the invention. Those skilled in the art will also appreciate that the features described above can be combined in various ways to form multiple embodiments. As a result, the invention is not limited to the specific embodiments described above, but only by the claims and their equivalents.

We claim:

1. A paper towel dispenser for dispensing paper toweling from a paper roll, the paper towel dispenser comprising:

a housing;

a right mechanical side connected to the housing and having a radial cam;

a left mechanical side connected to the housing and having a radial cam;

a right roll holder connected to the right mechanical side;

a left roll holder connected to the left mechanical side;

a drum having a center and an outer circumferential surface, the drum defining an interior space and operatively connected to the right and left mechanical sides, the drum receiving paper toweling from a paper roll located between the right roll holder and left roll holder, the paper toweling contacting the outer circumferential surface of the drum and rotating with the drum as a pulling force is applied to a leading edge of the paper toweling;

a blade assembly having two terminal ends and a blade located in the interior space of the drum, the blade assembly pivotally movable within the interior space of the drum to move from a first blade position where the blade is fully contained within the interior space of the drum to a second blade position where the blade protrudes beyond the outer circumferential surface of the drum, the blade assembly moving between the first blade position and second blade position when the drum rotates in response to the pulling force; and a top roller having two terminal ends and operably positioned to contact the paper toweling between the paper roll and the drum, the terminal ends of the top roller positioned in the radial cams of the right mechanical side and the left mechanical side, wherein the top roller moves along the outer circumference of the drum and dampens forces applied to the paper roll when the pulling force is applied to the leading edge of the paper toweling, and wherein the terminal ends of the top roller translate along the radial cams such that the top roller moves circumferentially relative to the drum and is restrained from moving toward the center of the drum.

2. The paper towel dispenser of claim 1 further comprising, at least one tension spring, wherein the tension spring is connected to a terminal end of top roller.

3. The paper towel dispenser of claim 1 further comprising a paper start configured to assist loading of the paper towel dispenser by positioning the leading edge of the paper toweling against the drum such that rotation of the drum causes the paper toweling to rotate with the drum and pass between the top roller and the drum to thereby load the paper towel dispenser.

4. The paper towel dispenser of claim 1 further comprising, at least one paper guide, the paper guide operably connected to the housing and paper toweling moves between the outer circumferential surface of the drum and the paper guide.

5. The paper towel dispenser of claim 1 further comprising, an indicator, the indicator pivotally connected to the housing, wherein the indicator contacts the paper roll and moves along the sloped grove as the paper towel roll is depleted.

6. The paper towel dispenser of claim 3, further comprising a tension spring, wherein the tension spring is connected to a terminal end of the top roller and the right mechanical side.

7. The paper towel dispenser of claim 3, further comprising a paper guide operably connected to the housing; and wherein the paper toweling moves between the outer circumferential surface of the drum and the paper guide.

8. The paper towel dispenser of claim 3, further comprising a rectangular indicator having two lower corners pivotally connected to the housing and two upper corners adjacent to sloped groves, and wherein the indicator contacts the paper roll such that the upper corners move along a sloped groove as the paper roll is depleted to thereby indicate the amount of paper toweling remaining in the paper towel dispenser.

* * * * *